US011097885B2

(12) United States Patent
Weston et al.

(10) Patent No.: US 11,097,885 B2
(45) **Date of Patent: *Aug. 24, 2021**

(54) CHILD-RESISTANT AND SENIOR-FRIENDLY ECO-FRIENDLY PILL DISPENSER BLISTER PACKAGE

(71) Applicant: Key-Pak Technologies, LLC, Wayne, NJ (US)

(72) Inventors: Michael H. Weston, Chapel Hill, NC (US); Frank Edward Smith, Cincinnati, OH (US)

(73) Assignee: Key-Pak Technologies, LLC, Wayne, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/208,357

(22) Filed: Dec. 3, 2018

(65) Prior Publication Data

US 2019/0367237 A1 Dec. 5, 2019

Related U.S. Application Data

(63) Continuation of application No. 15/144,685, filed on May 2, 2016, now Pat. No. 10,144,570, which is a (Continued)

(51) Int. Cl.
*B65D 83/04* (2006.01)
*B65D 77/22* (2006.01)

(Continued)

(52) U.S. Cl.
CPC ..... *B65D 77/22* (2013.01); *A61J 1/035* (2013.01); *B65D 5/38* (2013.01); *B65D 59/04* (2013.01);

(Continued)

(58) Field of Classification Search
CPC ..... B65D 5/38; B65D 75/327; B65D 77/22; B65D 83/0463; B65D 2215/02; B65D 2575/3227; A61J 1/035

(Continued)

(56) References Cited

U.S. PATENT DOCUMENTS 2,848,154 A 8/1958 Hanson
3,610,410 A 10/1971 Seeley (Continued)

FOREIGN PATENT DOCUMENTS

DE 19800755 A1 7/1999
GB 2421941 B 1/2008

(Continued)

*Primary Examiner* — Luan K Bui
(74) *Attorney, Agent, or Firm* — Bakos & Kritzer

(57) ABSTRACT

A blister and package system made of a blister card and an outer package with unique interacting locking mechanisms. The blister card or strip is inserted into the outer package or sleeve and locks immediately without having to further process the outer package or the blister card or strip. The user is able to expose the blisters from the outer package by disengaging the lock. The blister card or strip includes a formable, pliable sheet material, into which one or more individual cavities or blisters are formed. The separated cavities are loaded with product and sealed with one or more layers of puncturable or tearable sheet material, such as aluminum foil. The blister card or strip contains a plastic rivet assembly that forms an interference mechanism. The rivet is trapped by an internally formed panel and stopped by a catch flap included in the outer package.

13 Claims, 16 Drawing Sheets

Related U.S. Application Data continuation of application No. 13/731,045, filed on Dec. 30, 2012, now Pat. No. 9,326,913, which is a continuation of application No. 12/804,311, filed on Jul. 19, 2010, now Pat. No. 8,342,330.

(51) Int. Cl.

| | |
|---|---|
| ***B65D 75/32*** | (2006.01) |
| ***B65D 5/38*** | (2006.01) |
| ***A61J 1/03*** | (2006.01) |
| ***B65D 59/04*** | (2006.01) |
| ***B65D 77/04*** | (2006.01) |

(52) U.S. Cl.

CPC ..... *B65D 75/327* (2013.01); *B65D 77/0413* (2013.01); *B65D 83/0463* (2013.01); *B65D 2215/02* (2013.01); *B65D 2575/3227* (2013.01)

(58) Field of Classification Search

USPC ..... 206/530, 531, 532, 534, 538, 539, 468; 229/125.125

See application file for complete search history.

(56) References Cited

U.S. PATENT DOCUMENTS

| | | | | |
|---|---|---|---|---|
| 3,809,221 | A | 5/1974 | Compere | |
| 3,811,564 | A | 5/1974 | Braber | |
| 4,125,190 | A | 11/1978 | Davie et al. | |
| 4,294,361 | A | 10/1981 | Margulies et al. | |
| 4,398,634 | A | 8/1983 | McClosky | |
| 4,506,789 | A | 3/1985 | Dlugosz | |
| 4,537,312 | A | 8/1985 | Intini | |
| 4,567,986 | A | 2/1986 | Eastwood | |
| 4,806,399 | A | 2/1989 | Gibbons et al. | |
| 4,889,236 | A | 12/1989 | Bartell et al. | |
| 4,988,004 | A | 1/1991 | Intini | |
| 5,019,125 | A | 5/1991 | Rebne et al. | |
| 5,046,618 | A | 9/1991 | Wood | |
| 5,088,603 | A | 2/1992 | Kirkpatrick | |
| 5,109,984 | A | 5/1992 | Romick | |
| 5,172,812 | A | 12/1992 | Wharton et al. | |
| 5,210,060 | A | 5/1993 | Radlowski et al. | |
| 5,275,291 | A | 1/1994 | Sledge | |
| 5,325,968 | A | 7/1994 | Sowden | |
| 5,339,960 | A | 8/1994 | Price | |
| 5,469,968 | A | 11/1995 | Matthews et al. | |
| 5,511,665 | A | 4/1996 | Dressel et al. | |
| 5,758,774 | A | 6/1998 | Leblong | |
| 5,775,505 | A | 7/1998 | Vasquez et al. | |
| 5,785,180 | A | 7/1998 | Dressel et al. | |
| 5,791,478 | A | 8/1998 | Kalvelage et al. | |
| 5,862,915 | A | 1/1999 | Plezia et al. | |
| 5,878,888 | A | 3/1999 | Faughey et al. | |
| 5,894,930 | A | 4/1999 | Faughey et al. | |
| 5,927,500 | A | 7/1999 | Godfrey et al. | |
| 5,944,191 | A | 8/1999 | Ray et al. | |
| 6,021,623 | A | 2/2000 | Bouthiette | |
| 6,047,829 | A * | 4/2000 | Johnstone | B65D 5/38 206/1.5 |
| 6,161,699 | A | 12/2000 | Gartland | |
| 6,230,893 | B1 * | 5/2001 | Karow | B65D 5/38 206/1.5 |
| 6,273,260 | B1 | 8/2001 | ColDepietro et al. | |
| 6,338,407 | B2 | 1/2002 | Danville | |
| 6,349,831 | B1 | 2/2002 | Buss | |
| 6,394,275 | B1 | 5/2002 | Paliotta et al. | |
| 6,412,636 | B1 * | 7/2002 | Jones | B65D 5/38 206/532 |
| 6,422,391 | B1 | 7/2002 | Swartz | |
| 6,460,693 | B1 | 10/2002 | Harrold | |
| 6,491,211 | B1 * | 12/2002 | Evans | B65D 5/38 206/532 |
| 6,520,329 | B1 | 2/2003 | Fuchs et al. | |
| 6,669,236 | B1 | 12/2003 | Höllwarth-Oberholz | |
| 6,675,972 | B2 | 1/2004 | Patterson | |
| 6,705,467 | B1 | 3/2004 | Kancsar et al. | |
| 6,752,272 | B2 | 6/2004 | Jones et al. | |
| 6,776,285 | B2 | 8/2004 | Shibata | |
| 6,874,636 | B2 * | 4/2005 | Paliotta | B65D 75/327 206/1.5 |
| 6,974,032 | B2 | 12/2005 | Intini | |
| 7,063,211 | B2 | 6/2006 | Williams-Hartman | |
| 7,090,079 | B2 | 8/2006 | Ehrlund | |
| 7,188,728 | B2 | 3/2007 | Williams-Hartman | |
| 7,325,689 | B2 * | 2/2008 | Buss | B65D 83/0463 206/532 |
| 7,389,875 | B2 | 6/2008 | Sandberg et al. | |
| 7,389,907 | B2 | 6/2008 | Smith | |
| 7,448,496 | B2 | 11/2008 | Williams-Hartman | |
| 7,497,331 | B2 | 3/2009 | Pham | |
| 7,506,761 | B2 | 3/2009 | Levy | |
| 7,658,287 | B2 | 2/2010 | Hession | |
| 7,845,496 | B2 | 12/2010 | Hession | |
| 7,900,772 | B2 * | 3/2011 | Sack | A61J 1/035 206/1.5 |
| 7,905,355 | B2 | 3/2011 | Williams-Hartman | |
| 7,959,004 | B2 | 6/2011 | Tsao | |
| 8,011,512 | B2 | 9/2011 | Brollier et al. | |
| 8,544,650 | B2 | 10/2013 | Williams-Hartman | |
| 8,701,974 | B2 | 4/2014 | Davies et al. | |
| 2001/0017273 | A1 | 8/2001 | Raj et al. | |
| 2002/0100709 | A1 | 8/2002 | Shibata | |
| 2003/0006163 | A1 | 1/2003 | Patterson | |
| 2003/0047482 | A1 | 3/2003 | Jones et al. | |
| 2003/0085262 | A1 | 5/2003 | Evans et al. | |
| 2006/0131205 | A1 | 6/2006 | Sandberg et al. | |
| 2007/0045149 | A1 | 3/2007 | Hession | |
| 2007/0138049 | A1 | 6/2007 | Bitner | |
| 2007/0199857 | A9 | 8/2007 | Baker et al. | |
| 2007/0272586 | A1 | 11/2007 | Hession | |
| 2008/0156686 | A1 | 7/2008 | Hluchan et al. | |
| 2008/0308449 | A1 | 12/2008 | Intini | |
| 2008/0314780 | A1 | 12/2008 | Weston | |
| 2009/0045096 | A1 * | 2/2009 | Knutson | B65D 25/04 206/570 |
| 2009/0184023 | A1 * | 7/2009 | Brollier | A61J 1/035 206/531 |
| 2009/0242451 | A1 * | 10/2009 | Kessler | B65D 75/327 206/531 |
| 2009/0301924 | A1 | 12/2009 | Rondeau | |
| 2010/0065459 | A1 | 3/2010 | Tsao | |
| 2010/0252478 | A1 | 10/2010 | Beecroft et al. | |

FOREIGN PATENT DOCUMENTS

| | | | |
|---|---|---|---|
| JP | 2000291307 | A | 10/2000 |
| JP | 2003081336 | | 3/2003 |
| WO | 2005068316 | A3 | 12/2005 |
| WO | 2006068602 | A1 | 6/2006 |
| WO | 2008070622 | A1 | 6/2008 |
| WO | 2010011627 | A1 | 1/2010 |

* cited by examiner

CHILD-RESISTANT AND SENIOR-FRIENDLY ECO-FRIENDLY PILL DISPENSER BLISTER PACKAGE

CROSS-REFERENCE TO RELATED APPLICATION

This application is a continuation of U.S. patent application Ser. No. 15/144,685, filed May 2, 2016, now U.S. Pat. No. 10,144,570, which is a continuation of U.S. patent application Ser. No. 13/731,045, filed on Dec. 30, 2012, now U.S. Pat. No. 9,326,913, which is a continuation of U.S. patent application Ser. No. 12/804,311, filed on Jul. 19, 2010, now U.S. Pat. No. 8,342,330.

FIELD OF THE INVENTION

This invention relates to the field of packaging, and more particularly, to a dispenser package having a blister strip encapsulated in an outer sleeve. The package, preferably, has a locking function designed to provide senior citizens easy access to the contained drugs while preventing a child from gaining access to the contents of the blister strip.

BACKGROUND OF THE INVENTION

Blister card packages are commonly used for distribution of many products including pharmaceutical drugs, batteries, sewing kits, toy cars, etc. A blister card package is used as a stiffener or backing sheet for packaging a product contained in a blister, which may comprise a blister strip having a single row of individual blisters, or a solid form blister having a two-dimensional matrix of individual blisters (which will be discussed in more detail below). Typically, the blister card package is comprised of pre-printed stiff paper, such as cardboard, that is folded to create at least two adjacent sides. One or both of the sides typically contain an aperture. The product to be packaged is usually encased in a clear plastic individual blister, which may be inserted between the two adjacent sides of the blister card package such that the product protrudes from one or both apertures. The two cardboard sides are then sealed, typically via application of heat and pressure, to retain the plastic individual blister within its blister card packaging.

Blister card packages may accommodate individual blisters (as illustrated above) or may be designed to accept blister strips or solid form blisters. The latter are commonly used to package pharmaceutical drugs for public distribution or clinical trials. Pharmaceutical drugs are distributed in many forms such as capsule, pill, lozenge, etc., which are amenable to distribution in blister strips or solid form blisters.

A blister strip comprises a contiguous strip of plastic individual blisters having a common backing, such as foil, that is one unit wide by any number of units long. In contrast, solid form blisters comprise both horizontal and vertical rows of individual blisters, however, solid form blisters also typically share a common backing.

Blister strips and solid form blisters are popular containers for pharmaceutical drugs because the strips may be specially configured to meet the dosage requirements of the drug. For example, an antibiotic drug prescription may require 16 pills to be taken in a specific order. The blister strip or solid form blister may be manufactured such that the pills are packaged in the same order that the pills should be taken. The blister strip or solid form blister may then be packaged in a pre-printed blister card package that contains printed instructions regarding when and how to take each dose. (Additionally, the insertion of one 16-dose strip or one 4-dose wide by 4-dose long solid form blister into a blister card package is much easier to perform than the insertion of 16 distinct blisters arranged in a specific order). Therefore, pharmaceutical drugs distributed to the public or used in clinical trials are typically packaged in blister strips or solid form blisters contained within a sealed blister card package.

Many blister card packaged products, especially pharmaceutical drugs, can be harmful, or even lethal, to children or mentally impaired adults. At the same time, however, the products contained in blister card packages may be vital to the health of other adults including senior citizens, some of which may have impaired physical and cognitive skills and/or poor eyesight. Consequently, it is desirable to manufacture blister card packages that impede a child's access to the product contained in the blister while simultaneously facilitating a senior citizen's access to its content. Such packaging is known in the art and is commonly referred to as child-resistant and senior-friendly packaging.

The federal government has implemented various laws to ensure that materials deemed by the government to be dangerous are packaged in child-resistant and senior-friendly packaging. Specifically, the federal government enacted the Poison Prevention Act of 1970 ("PPA")(Pub. L. 91-601, 84 Stat. 1670, 15 U.S.C. 1471-75) on Dec. 30, 1970, which is incorporated herein by reference. The Poison Prevention Act of 1970 requires harmful substances to be packaged in child-resistant packaging, i.e., such that children under 5 years of age, having no physical or mental handicaps, cannot "open or obtain a harmful amount of the substance contained therein within a reasonable time" and senior-friendly packaging, i.e., such packaging must also "not [be] difficult for normal adults to use properly." Notably, the PPA does not require that children be prevented from opening or obtaining a toxic or harmful amount of the substance 100 percent of the times attempted. When the substance is packaged in individual units, the Code of Federal Regulations requires that child-resistant packaging is effective no less than 80 out of every 100 attempts (16 C.F.R. 1700.15(b)(1)). Conversely, senior adults between ages 50 and 70, having no mental or physical disabilities, should be able to open the packaging no less than 90 out of every 100 attempts when permitted to view printed instructions that accompany the packaging (16 C.F.R. 1700.15(b)(2)(i-ii), 16 C.F.R. 1700.20(a)(3)(i), 16 C.F.R. 1700.20 (a)(3)(iv)).

To ensure compliance with the aforementioned federal guidelines, blister card packaging is submitted to a testing agency, which determines the child-resistance rating and whether or not the packaging is senior-friendly. Packaging is rated as senior-friendly solely based on the 90 percent guideline, i.e., senior adults are able to open the packaging at least 90 times out of every 100 attempts. However, the child resistance rating is determined on a scale ranging from F1 through F8. The F represents "fatal at" and the following number represents the number of doses, therefore, F4 is "fatal at 4 doses." (Consequently, the more difficult it is for a child to access a product contained within a blister card package, the lower the child-resistance rating applied to the packaging). It is intuitive that products contained within packaging rated at F1, i.e., lethal at one dose, should be very difficult for children to access, whereas, products rated at F8, i.e., lethal at 8 doses, do not require the same level of difficulty. A blister card package that is to be used for distribution of potentially lethal pharmaceutical drugs or clinical trial drugs must pass the aforementioned federal guidelines prior to use. Additionally, the child resistance rating will determine what type of pharmaceutical drugs can be distributed within each rating of packaging, i.e., a pharmaceutical drug that is lethal at three doses cannot be packaged in a blister card package that is rated F4 through F8. When the lethal dose of a drug has not been established, federal regulations require an assumption that the drug is lethal at eight doses, therefore, such a drug may be distributed in packaging rated F8.

Blister card packages exist today that have passed the federal child-resistant and senior-friendly testing guidelines. Many existing, patented blister card packages were originally designed for distribution of non-lethal drugs and, therefore, were not required to pass the federal testing guidelines. To sell to a larger market of users, these blister card packages were modified to achieve child-resistance using a variety of methods including adding paperboard layers, adding plastic or tape layers to the exterior of the paperboard, reinforcing a frangible foil backing with a less frangible paper, etc.

After the aforementioned modifications were made, many blister card packages that were previously non-child-resistant were able to pass child resistance testing, however, the packaging became undesirable in other ways. For example, the additional, reinforced layers often prevented the pills from being pushed cleanly through the blister backing and thereby caused degradation of the backing of other adjacent pills. Specifically, some blister card package manufacturers have added a layer of paper to the foil backing through which a pill is pushed. The paper and/or foil backing sometimes does not tear cleanly, leaving the user only one option: scraping the backing until enough of it is removed to allow the user to grasp and peel the backing enough to reach the pill. This can be very difficult, especially for senior citizens or other adults with impaired physical abilities. Additionally, these blister card packages have been manufactured with more than a minimal amount of plastic, which does not make them environmentally viable to produce or dispose after use.

To address some of the concerns mentioned above, manufacturers have looked at alternative forms of packaging for containing medications in secure packages that are sturdy enough to be opened and closed numerous times until the course of medication is completed, yet having a locking function to prevent a child from accessing the medications. Various packages have been utilized comprising a two-piece paperboard container having an internal slide card housing medications and contained within an outer paperboard shell. While these devices have a locking mechanism for preventing access by a child, they do not prevent the slide card from being pulled completely from the paperboard shell upon applying sufficient force to a push-button tab. Yet other packages are not easy to assemble in a flat-laid, pre-glued distribution of a package.

Thus, there is a clear need for child-resistant and senior-friendly packages that have a locking function that achieves a high child resistance rating when tested while remaining easy to use for senior citizens through multiple uses of the package until dosage is depleted. There is a further need for child-resistant and senior-friendly packaging that is environmentally friendly and which requires minimal modifications to a customers established blister layout reducing cost and increasing speed to market.

SUMMARY OF THE INVENTION

Generally, the invention provides an improved child-resistant and senior-friendly pill dispenser package particularly suited to distribution of pharmaceutical drugs for public or clinical trial use. Specifically, the pill dispenser package of the invention achieves federally mandated child-resistant and senior-friendly guidelines through a locking function while also providing a pill dispenser package that is easy to use for all adults including those with impaired physical abilities. Additionally, the pill dispenser package of the invention allows an individual pharmaceutical drug to be removed from the pill dispenser multiple times without degrading the child resistance rating of the pill dispenser packaging enclosing the remaining pharmaceutical drugs.

It is an object of the invention to provide pill or pharmaceutical dispensing packaging that is difficult for a child to open.

Additionally, it is an object of the invention to provide packaging that is easily accessible to competent adults and senior citizens including those with impaired physical abilities.

It is also an object of the invention to provide child-resistant and senior-friendly packaging that passes federally mandated guidelines.

Also, it is an object of the invention to provide packaging that is easily and inexpensively manufactured.

Further, it is an object of the invention to provide packaging that is environmentally friendly.

Additionally, it is an object of the invention to provide packaging that utilizes established blister strip layout in the marketplace.

In addition, it is an object of the invention to provide packaging that allows instructions to be printed directly on the packaging.

In one non-limiting aspect of the invention, a packaging apparatus is provided and includes an inside panel, a bottom panel, and an inside folding panel connecting the top panel to the inside panel and an inside closing panel connected to the inside panel along a left panel. A left folding panel connects the bottom panel and the top panel to each other and a right folding panel connects a top closing panel to the bottom panel. A bottom right panel connects to a top right panel along a first common edge. The inside panel is connected to the top right panel along a second common edge, where the inside closing panel, inside panel, inside folding panel, top panel, left folding panel, bottom panel, tight folding panel, and top closing panel form a sleeve having an opening, the sleeve having a substantially rectangular cross-section. The inside panel includes a rectangular cut-out on an edge directly opposite the second common edge. The sleeve is adapted to receive an insert slidable therein along a sliding direction normal to the rectangular cross-section, where the insert includes a locking member coupled to the rectangular cutout. The locking member prevents the sleeve from sliding out of the sleeve when the locking member is engaged with the rectangular cut-out.

In a second non-limiting aspect of the invention, a blister and package system is provided including a blister card or strip and an outer package with unique interacting locking mechanisms. The blister card is inserted in the outer package and locks immediately without having to further process the outer package or the blister card. The user is able to expose the blisters from the outer package by disengaging the lock. The blister card includes a formable, pliable sheet material, into which one or more individual cavities or blisters are formed. The separated cavities are loaded with product and sealed with one or more layers of puncturable or tearable sheet material, such as aluminum foil. The blister card contains an interface mechanism such as a plastic rivet assembly. The rivet is, preferably, trapped by an internally formed panel and stopped by a catch flap included in the outer package.

Other objects, features and characteristics of the invention, as well as the methods of operation and functions of the related elements of the structure, and the combination of parts and economies of manufacture, will become more apparent upon consideration of the following detailed description with reference to the accompanying drawings, all of which form a part of this specification.

BRIEF DESCRIPTION OF THE DRAWINGS

A further understanding of the invention can be obtained by reference to a preferred embodiment set forth in the illustrations of the accompanying drawings. Although the illustrated embodiment is merely exemplary of systems and methods for carrying out the invention, both the organization and method of operation of the invention, in general, together with further objectives and advantages thereof, may be more easily understood by reference to the drawings and the following description. The drawings are not intended to limit the scope of this invention, which is set forth with particularity in the claims as appended or as subsequently amended, but merely to clarify and exemplify the invention.

For a more complete understanding of the invention, reference is now made to the following drawings in which.

DETAILED DESCRIPTION OF THE INVENTION

The invention may be understood more readily by reference to the following detailed description of preferred embodiment of the invention. However, techniques, systems and operating structures in accordance with the invention may be embodied in a wide variety of forms and modes, some of which may be quite different from those in the disclosed embodiment. Consequently, the specific structural and functional details disclosed herein are merely representative, yet in that regard, they are deemed to afford the best embodiment for purposes of disclosure and to provide a basis for the claims herein, which define the scope of the invention. It must be noted that, as used in the specification and the appended claims, the singular forms "a", "an", and "the" include plural referents unless the context clearly indicates otherwise.

Figure 1:
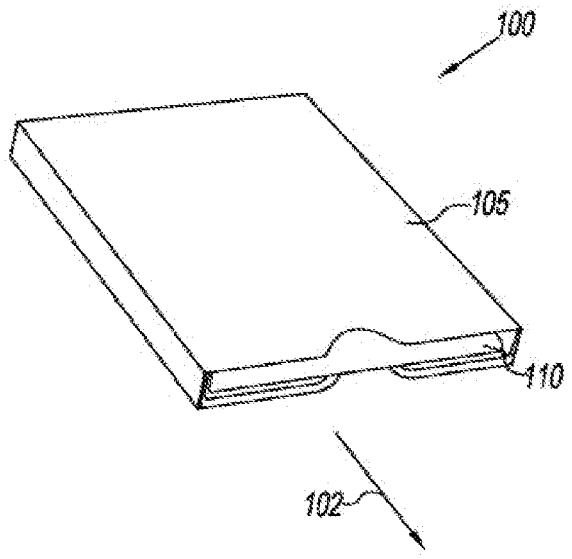
FIG. 1 is a top perspective view of a pill dispenser in a closed position in accordance with the preferred embodiment of the invention.
Figure 2:
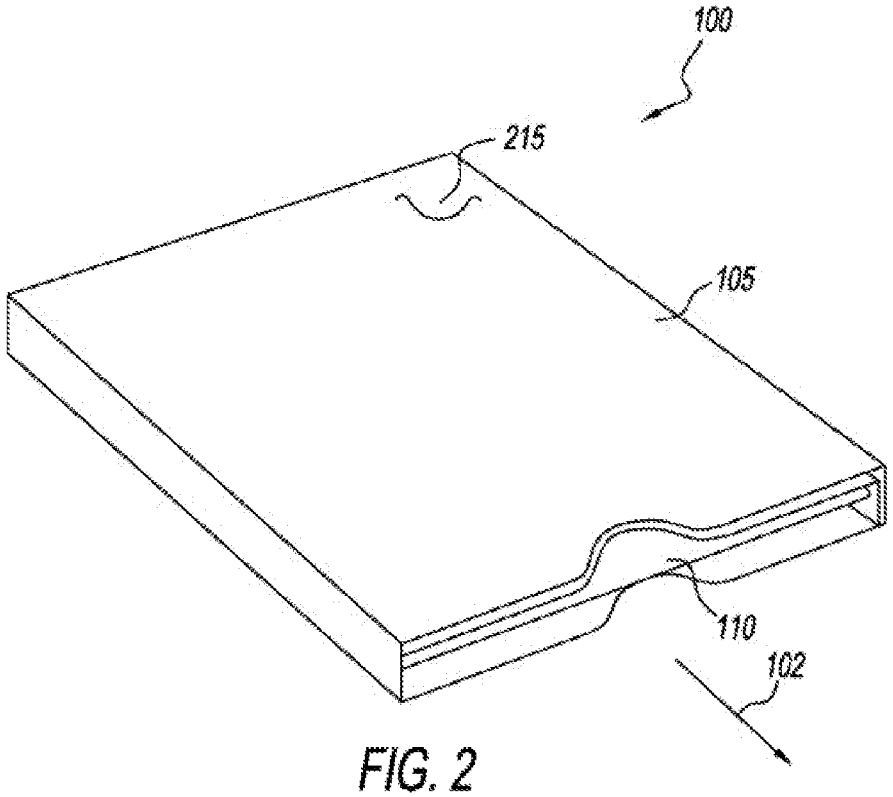
FIG. 2 is a bottom perspective view of the pill dispenser shown in FIG. 1 in accordance with the preferred embodiment of the invention.
Figure 5:
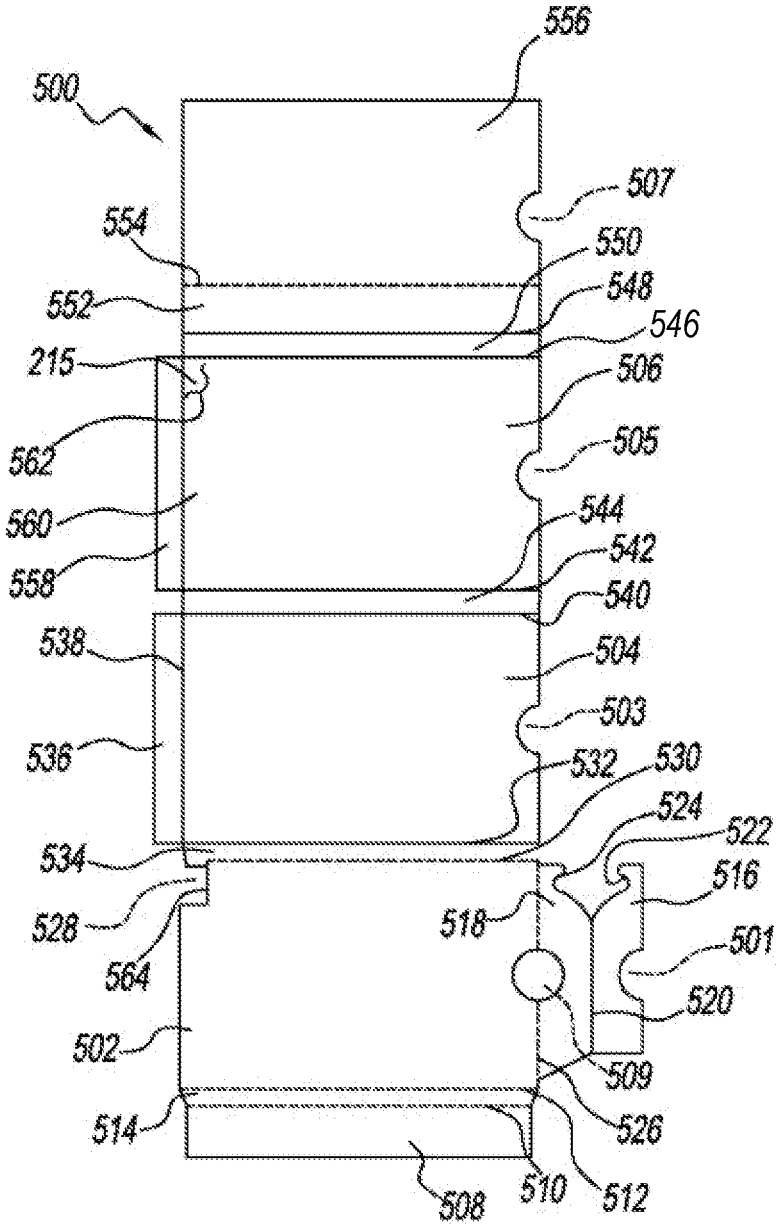
FIG. 5 is a top plane view of the pill dispenser in accordance with the preferred embodiment of the invention in an unfolded position.

Referring to FIGS. 1 and 2, shown is an environmentally friendly pill dispenser 100 comprising sleeve 105 adapted to receive an insert, such as for example, a blister strip 110 according to a preferred embodiment of the invention. As shown, the blister strip or card 110 and its contents may be selectively accessed from inside sleeve 105 by sliding the blister strip 110 in a sliding motion along direction 102 in order to expose the contents of blister strip 110. The pill dispenser 100, preferably, includes a locking function comprising a selectively depressible button 215 (shown in FIG. 2) formed by a partial cut-out, which is shown in FIG. 5. The button 215 may be depressed in order to disengage blister strip 110 from sleeve 105, thereby releasing the blister strip 110 and enabling the blister strip 110 to slide along direction 102 and expose the blister strip 110 from the sleeve 105, which is shown and described below. It should be appreciated that blister strip 110 engages a lip 564 (shown in FIG. 5) formed internally by folding the various panels to create sleeve 105 and sliding the blister strip 110 prior to pushing the button 215 prevents the lip 564 (FIG. 5) from disengaging the blister strip 110 and preventing the blister strip 110 from sliding out of the sleeve 105, as shown and described below. It should also be appreciated that the blister strip 110 may be inserted into the sleeve 105 and locks immediately without having to further process the sleeve 105 or the strip 110.

Figure 3A:
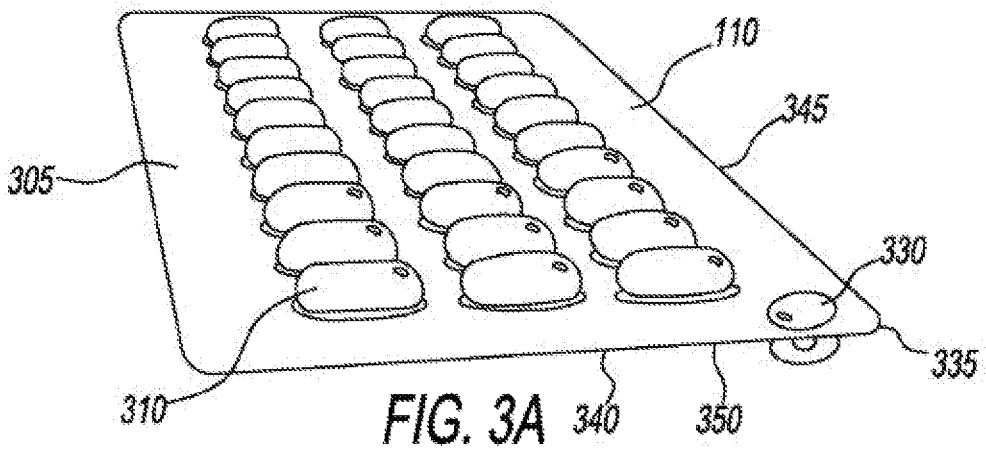
FIG. 3A is a top perspective view of a blister strip in accordance with the preferred embodiment of the invention.
Figure 3B:
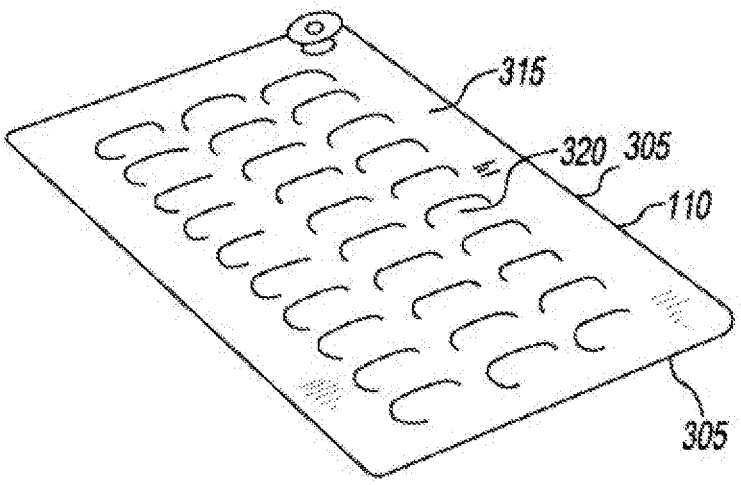
FIG. 3B is a bottom perspective view of the blister strip shown in FIG. 3 in accordance with the preferred embodiment of the invention.
Figure 4:
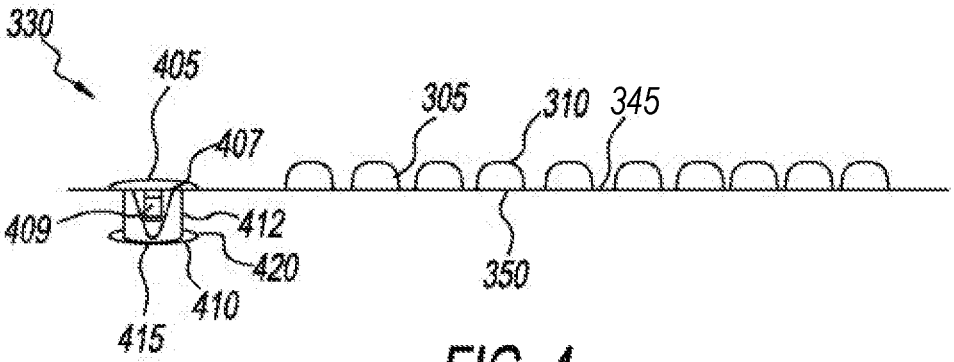
FIG. 4 is an end cross-sectional view of the blister strip shown in FIG. 3A-3B in accordance with the preferred embodiment of the invention.

Referring now to FIGS. 3A, 3B and 4, shown is a view of blister strip 110 for use with the sleeve 105 according to the preferred embodiment of the invention. As shown in FIG. 3A, blister strip 110 comprises base 305, which is preferably constructed from a flexible, semi-rigid plastic, however, various other materials may be used including injected mold plastics, thick foil, etc. Blister strip 110 also comprises blisters, such as blister 310 formed from the base 305. Blister 310 includes a cavity for receiving a product, such as a pill or tablet (i.e., blister strip 110 includes a formable, pliable sheet material into which one or more individual cavities may be formed), although in other non-limiting examples, blister 310 may contain non-pharmaceutical products. In one non-limiting example, blister strip 110 is shown as a "solid form blister" arranged in a two-dimensional matrix, however, any number of blisters 310 may be utilized with the invention. Also, blister strip 110 includes a plastic rivet assembly 330 provided along rear edge 340 at corner 335 and which extends from top surface 345 to bottom surface 350, with the rivet assembly 330 forming the interference mechanism for engaging sleeve 105 (Shown in FIG. 1). Plastic rivet assembly 330 is provided to engage lip 564 (FIG. 5) formed internally by folding the various panels forming sleeve 105 (Shown in FIG. 1) thereby enabling the locking function of sleeve 105 (FIG. 1), as will be shown and described below. In other non-limiting embodiments, plastic rivet assembly 330 may be provided along the center of rear edge 340 without departing from the scope of the invention. The rivet assembly 330 is trapped by an internally formed panel and stopped by a flap included in the sleeve 105, which will be shown and described below.

Turning now to FIG. 3B, the rear perspective view of blister strip 110 illustrates backing 315, affixed to the bottom surface of base 305 and which acts as seals 320 for sealing the openings of each corresponding blister 310. Backing 315 is preferably constructed from one or more layers of puncturable or tearable sheet material such as, for example, aluminum foil, however, other types of foil or other materials such as paper and plastic may be used. In one non-limiting embodiment, backing 315 may comprise perforations or cut-scores (not shown) surrounding the portion of the backing that coincides with the perimeter of the individual blister opening (i.e., seal 320) to assist the user in penetrating the portion of backing 315 that acts as seals 320 or pushing the contents of the blister 310 through seal 320. Preferably, seals 320 of blister strip 110 are frangible to prevent damage to a capsule or other item contained within blister 310 when the capsule or item is pushed through the frangible layer. Also, blister 310 is preferably constructed from a tear and puncture resistant, durable, flexible, semi-rigid material, thus allowing the user to push on individual blister 310 forcing the capsule or item through seal 320 while preventing breakage of capsule or item. Further, blister 310 may be formed as indentations in base 305 or may be constructed from a different material that is adhered to base 305.

As shown in greater detail in FIG. 4, plastic rivet assembly 330 includes a male rivet member 405 selectively coupled to female rivet member 410 in order to enable the locking function of sleeve 105 (FIG. 1), although in other non-limiting examples, an air duct retainer or other similar types of retainers may be utilized in lieu of rivet assembly 330. The male rivet member 405 includes a disc-shaped member 407 coupled to an orthogonal pin 409, which is received in aperture 415 formed in base 305. The disc-shaped member 407 abuts top surface 345 while pin 409 traverses aperture 415 and selectively locks with female rivet member 410 to selectively couple rivet assembly 330 to base 305. The female rivet member 410 is generally cylindrical in shape and comprises wall 412 having a length for catching internal lip 564 (FIG. 5) of sleeve 105 when blister strip 110 is in a locking position inside sleeve 105 while also being able to be released from lip 564 (FIG. 5) when blister strip 110 is in a non-locking position inside sleeve 105. Female rivet member 410 further has a circumferential edge 420 for preventing member 410 from being disengaged from lip 564 (FIG. 5) upon application of a force greater than necessary to slide blister strip 110 out of sleeve 105.

Turning to FIG. 5 discloses a blank 500 for forming sleeve 105 according to the preferred embodiment of the invention. Blank 500 is the sleeve 105 in an unfolded position. Blank 500 is preferably made of paperboard and may be coated with a polymer coating to make it more tear resistant, although in other non-limiting examples, blank 500 may be made from durable paper, composite material, or other similar types of materials. The blank 500 is preferably made up of several panels, which are folded along predetermined fold lines or pre-break lines in order to form sleeve 105. The fold lines may be scored while the pre-break lines are formed by a creasing operation, both of which are provided to make it easier to fold the various panels during assembly of sleeve 105. Also, during the manufacturing process of sleeve 105, the several panels are folded at desired folding angles (e.g., 90 degrees or 180 degrees) and panels 508, 504, 552, 536 and 558 may be glued together to permanently couple the panels together. As shown, blank 500 comprises inside panel 502, top panel 504 and bottom panel 506. Inside panel 502 is folded in relation to inside closing panel 508 about fold lines 510 (also third fold line) and 512 to form a left panel 514 between inside panel 502 and inside closing panel 508. Inside panel 502 includes a rectangular shaped cutout 528 to form a lip 564, which abuts rivet assembly 330 (FIG. 3A) and locks the blister strip 110 within sleeve 105.

Further bottom right panel 516 is preferably a mirror image of top right panel 518, with bottom right panel 516 folded onto top right panel 518 along fold line 520 (also first fold line). Bottom right panel 516 includes a hook 522 while top right panel 518 has a similar hook 524. Folding bottom right panel 516 over top right panel 518 folds hook 522 over hook 524, with hooks 522 and 524 causing rivet assembly 330 to abut against hooks 522 and 524 to prevent disengagement of the blister strip 110 from sleeve 105. Also, top right panel 518 and bottom right panel 516 are folded along fold line 526 (also second fold line) to provide hooks 522 and 524 at front of sleeve 105 and thereby provide an obstruction to prevent blister strip 110 from disengaging from sleeve 105 without application of force by a user. Further, blank 500 is provided with a plurality of substantially similar semi-spherical cutouts 501, 503, 505 and 507 on bottom right panel 516, top panel 504, bottom panel 506 and top printing panel 556 respectively and a spherical cutout 509 on the edge 526 separating top right panel 518 from inside panel 502. Cut-outs 501, 509, 503 and 505 form grip-openings of sleeve 105 making it possible to slide blister strip 110 (FIG. 3A-3B) substantially out of the sleeve 105 with a simple finger-grip.

Also as shown in FIG. 5, inside panel 502 is folded in relation to top panel 504 about fold line 530 (also fourth fold line) and pre-break line 532 to form inside folding panel 534 between inside panel 502 and top panel 504. Top rear panel 536 is folded along pre-break line 538 to form a top back wall for sleeve 105. Top panel 504 is folded in relation to bottom panel 506 about fold line 540 (also fifth fold line) and pre-break line 542 to form a left folding panel 544. Bottom rear panel 558 is folded along pre-break line 560 to form a bottom back wall for sleeve 105. Bottom panel 506 includes partial cut-out 562 that acts as a button 215 (shown in FIG. 2) that must be depressed in a direction perpendicular to the plane of the paper in order to release the blister strip 110 (FIG. 3A-3B) and enable a user to slide the blister strip 110 out of a locked position inside sleeve 105 (FIG. 2). Bottom panel 506 is folded in relation to top closing panel 552 along fold line 546 (also sixth fold line) and pre-break line 548 to form right folding panel 550. Left folding panel 544 and right folding panel 550 define the thickness of sleeve 105 along the left and right edges respectively. Top closing panel 552 is connected to top printing panel 556 along fold line 554, with top closing panel 552 being selectively provided with glue in order to adhesively couple the top closing panel 552 to the opposed surface of top panel 504, thereby holding sleeve 105 in its assembled form. The top printing panel 556 is selectively provided with fugitive glue (i.e., a low-tack adhesive that lacks permanence) or other similar type of glue in order to temporarily affix the sleeve 105 to marketing literature, for example, paper, a mailing envelope or a magazine, although in other non-limiting embodiments, the sleeve 105 may be supplied without top printing panel 556 by tearing panel 556 along fold-line 554 prior to shipping sleeve 105.

In operation and as shown in FIG. 1-5, blister strip 110 (FIG. 1) may be selectively locked within sleeve 105 to form a "F 1" child-resistant pill dispenser 100 by utilizing rivet assembly 330 (FIG. 3A) to engage internal lip 564 and lock blister strip 110 inside the cavity of sleeve 105 until rivet assembly 330 is disengaged. When the pill dispenser 100 is in its locked position, circumferential edge 420 (FIG. 4) resides below lip 564 (FIG. 5). Sliding blister strip 110 in direction 102 (FIG. 1) causes female rivet member 410 (FIG. 4) to abut lip 564 (FIG. 5) and prevent blister strip 110 from sliding out in direction 102 (FIG. 1). In order to release blister strip 110, a depressible force is applied to button 215 (FIG. 2) prior to sliding blister strip 110 (FIG. 1) in order to cause female rivet member (FIG. 4) to be pushed upwards and clear lip 564 (FIG. 5) thereby disengaging rivet assembly 330 (FIG. 3A) from lip 564 on inside panel 502 (FIG. 5). The blister strip 110 may then be selectively accessed by sliding blister strip 110 (FIG. 2) from sleeve 105 along direction 102 (FIG. 1). It should be appreciated that lip 564 (FIG. 5) may be formed to reside along the bottom surface of sleeve 105 by folding internally the various panels to create sleeve 105. It should also be appreciated that sliding the blister strip 110 prior to pushing the button 215 (FIG. 2) prevents the lip 564 (FIG. 5) from disengaging the rivet assembly 330 (FIG. 3A) even after force is applied to button 215 (FIG. 2) of sleeve 105 and preventing the blister strip 110 from sliding out of the sleeve 105.

Figure 6:
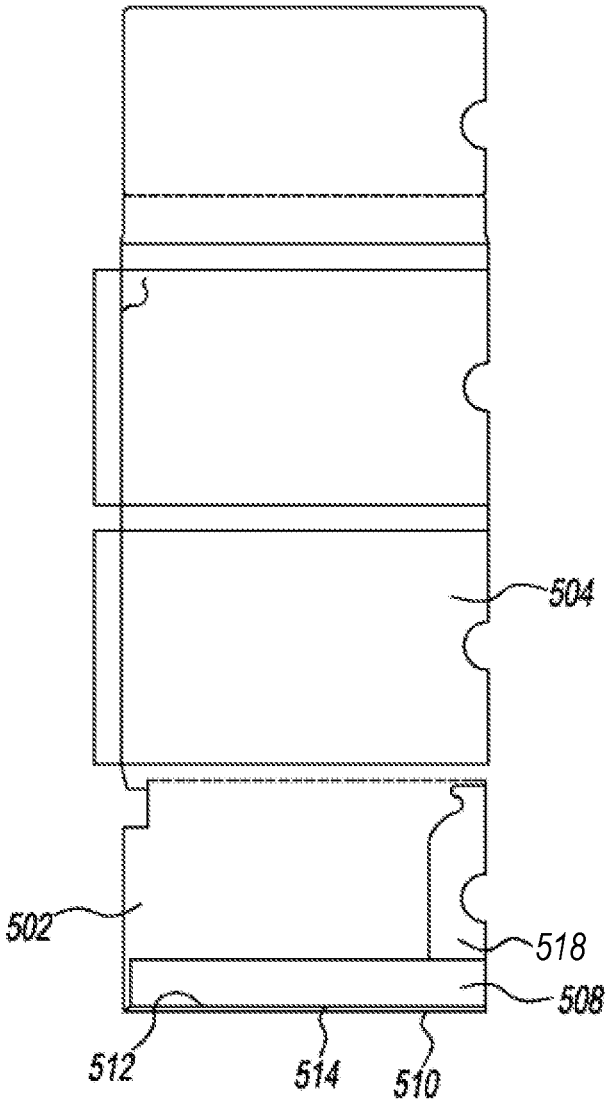
FIG. 6 is a top plane view of the housing shown in FIG. 5 with the inside closing panel, top right panel and bottom right panel in folded positions.

Referring now to FIG. 5-9, the process of assembling sleeve 105 may comprise folding the various panels of blank 500 in a predetermined order. First, as shown in FIGS. 5 and 6, bottom right panel 516 (FIG. 5) is folded 180 degrees along fold line 520 (also first fold line) to align bottom right panel 516 on top of top right panel 518. Next, as shown in FIG. 6, top right panel 518 is folded 180 degrees along fold line 526 (also second fold line) to position bottom right panel 516 and top right panel 518 within the perimeter of inside panel 502 (shown in FIG. 6). Next, inside closing panel 508 is folded 90 degrees in relation to left panel 514 along fold line 510 (also third fold line). Left panel 514 is folded along pre-break line 512 to position inside closing panel 508 within the perimeter of inside panel 502 (shown in FIG. 6).

Figure 7:
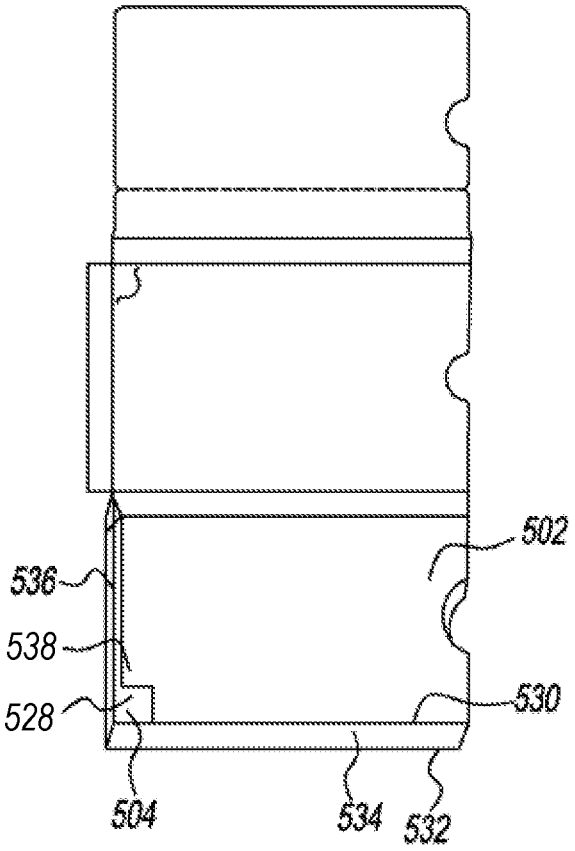
FIG. 7 is a top plane view of the housing shown in FIG. 6 with the inside closing panel, top right panel and bottom right panel in folded positions.
Figure 8:
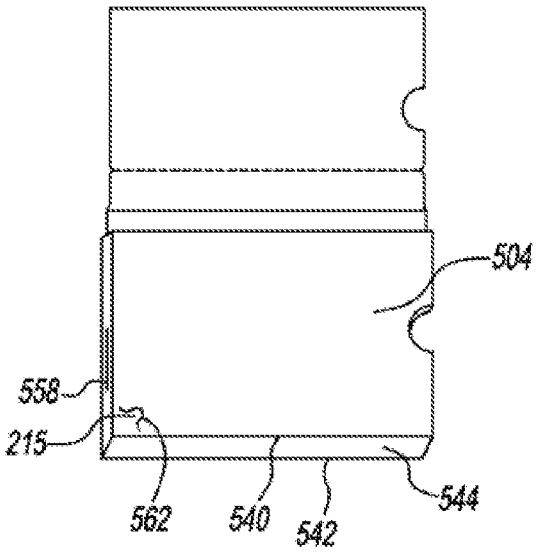
FIG. 8 is a top plane view of the housing shown in FIG. 7 with the top panel further in a folded position.

Next, as shown in FIG. 7, inside panel 502 is folded 90 degrees along fold line 530 (also fourth fold line) and resides within the perimeter of top panel 504 when inside folding panel 534 is folded 90 degrees along pre-break line 532. Further top rear panel 536 is folded along pre-break line 538 to form back wall and the inside surface of inside closing panel 508 (FIG. 5) is adhesively glued to inside surface of top panel 504 to form a permanent adhesive coupling. As shown in FIG. 8, blank 500 is folded 90 degrees along fold line 540 (also fifth fold line) and further folded 90 degrees along pre-break line 542 to cause inside panel 520 to reside on bottom panel 506 (FIG. 5). Further, bottom rear panel 558 is folded 90 degrees and is adhesively coupled to top rear panel 536 to form back wall.

Figure 9:
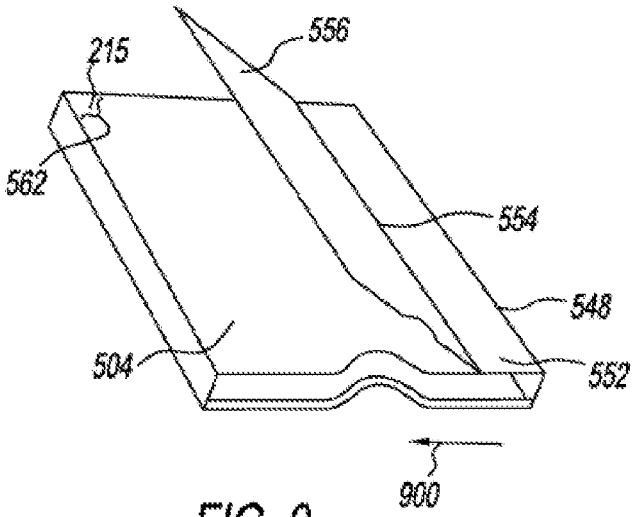
FIG. 9 is a perspective view of the assembled pill dispenser housing (or sleeve) shown in FIG. 1.

Next, as shown in FIG. 9, right folding panel 550 (FIG. 5) is folded 90 degrees along fold line 546 (also sixth fold line) along direction 900 and along pre-break line 548 to position top closing panel 552 inside the perimeter of top panel 504. Next, top closing panel 552 is adhesively coupled to top panel 504 by gluing inside surface of top closing panel 552 to exterior surface of top panel 504 to form sleeve 105. Gluing the panels causes sleeve 105 to stay fixed in the desired configuration. The top printing panel 556 is visible and fugitive glue may be applied to provide the sleeve 105 to be temporarily attached to marketing literature or other similar types of marketing materials.

Figure 10:
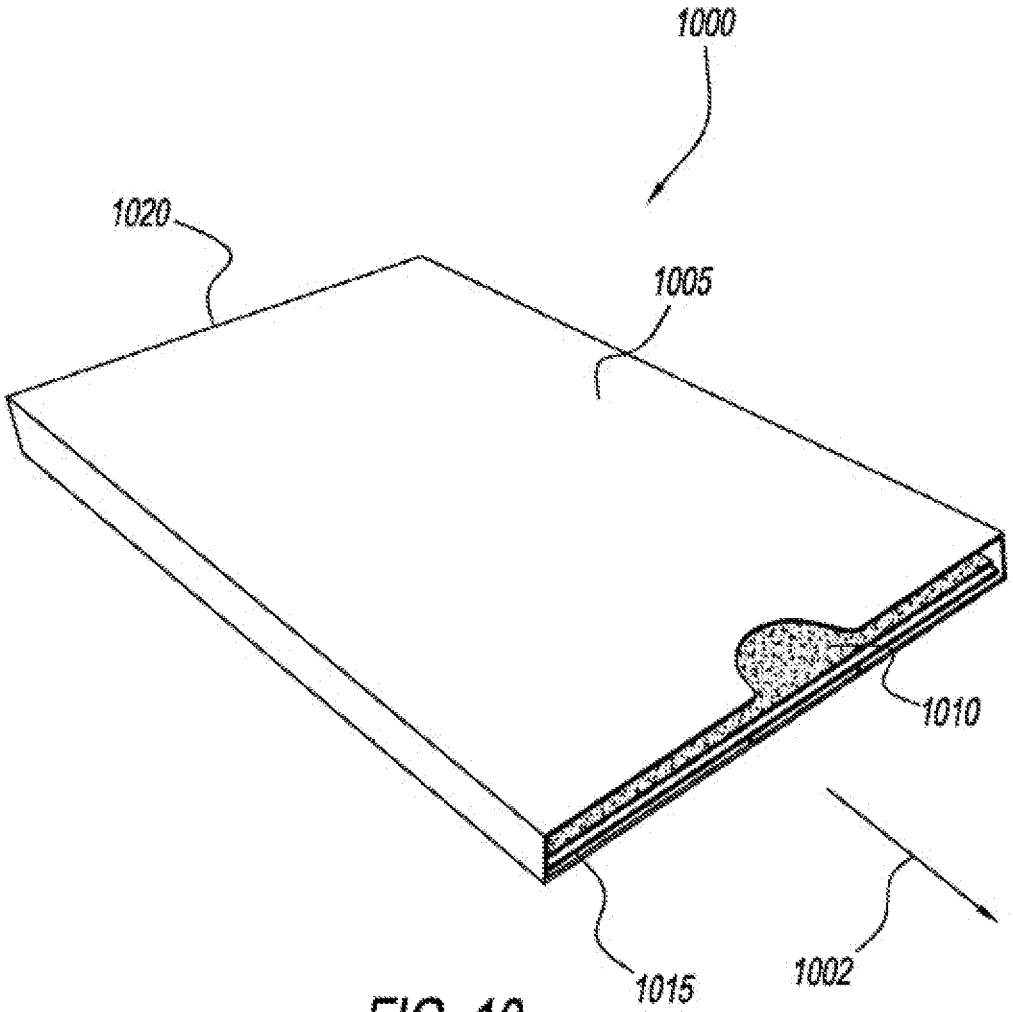
FIG. 10 is a perspective view of a pill dispenser in a locked position in accordance with an alternate embodiment of the invention.

In an alternate embodiment as shown in FIG. 10, pill dispenser 1000 may comprise sleeve 1005 adapted to receive an insert, such as for example, a blister strip 1010, which, in a locked position, resides within the cavity of sleeve 1005 from rear end 1020 to open end 1015. As shown, the blister strip 1010 may be selectively removed from the sleeve 1005 by sliding the blister strip 1010 in a sliding motion along direction 1002. The pill dispenser 1000 includes a locking function comprising a partially cut-out portion 1202 (shown in FIG. 12), which must be depressed in order to release the blister strip 1010 and enable the blister strip 1010 to slide along direction 1002, which will be shown and described below. It should be appreciated that blister strip 1010 includes a protrusion for engaging a lip 1204 (shown in FIG. 12) formed inside sleeve 1005 by folding the various panels. It should also be appreciated that pill dispenser 1000 includes a child-resistant locking feature whereby sliding the blister strip 1010 prior to pushing a button prevents the blister strip 1010 from being released within sleeve 1005, thereby preventing the blister strip 1010 from sliding out of sleeve 1005 and exposing the potentially dangerous contents of the blister strip 1010 to a child, which will be shown and described below.

Figure 11A:
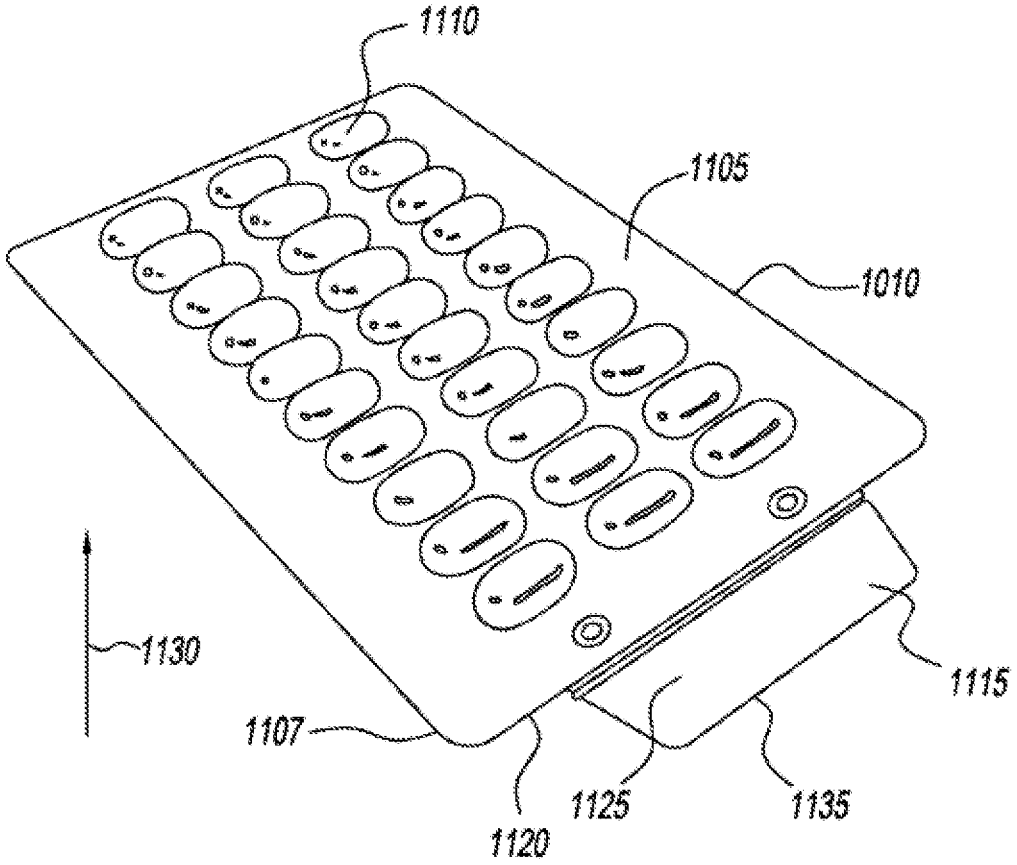
FIG. 11A is a top perspective view of a blister strip in accordance with an alternate embodiment of the invention.
Figure 11B:
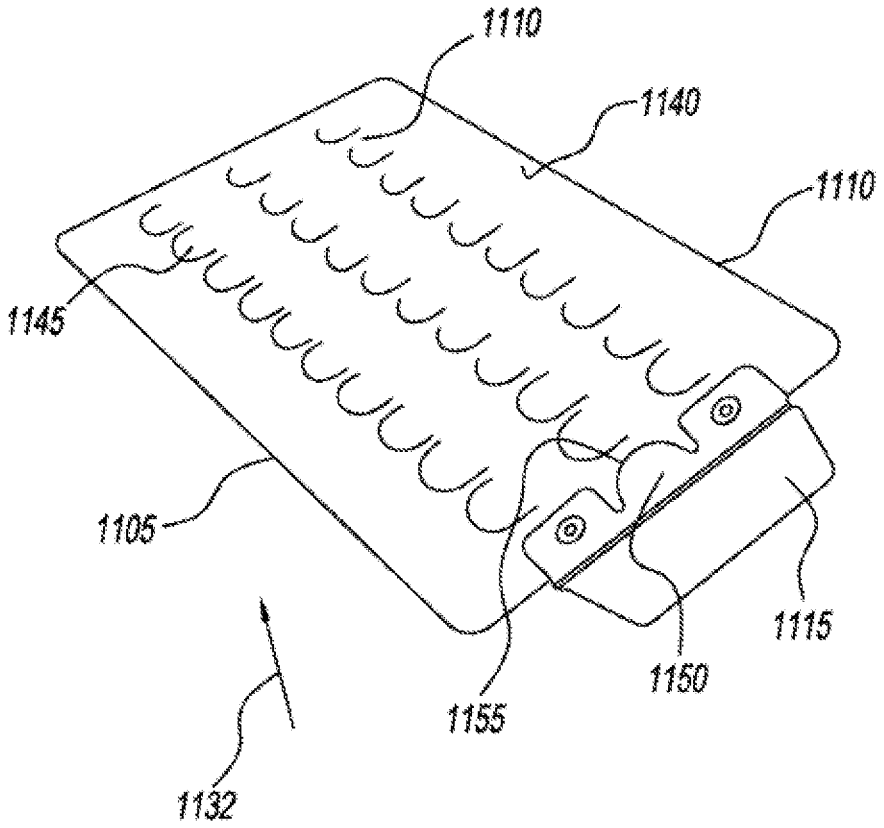
FIG. 11B is a bottom perspective view of the blister strip shown in FIG. 11A in accordance with an alternate embodiment of the invention.

Referring now to FIGS. 11A and 11B, shown are perspective views of blister strip 1010 for use with the sleeve 1005 (FIG. 10) according to an alternate embodiment of the invention. As shown in FIG. 11A, the top perspective view of blister strip 1010 is substantially similar to blister strip 110 shown and described in FIG. 3A-3B and includes base 1105, which is preferably constructed from a flexible, semi-rigid plastic, however, various other materials may be used including injected mold plastics, thick foil, etc. Blister strip 1010 also comprises blisters, such as blister 1110 formed from base 1105. Blister 1110 includes a cavity for receiving a product, such as a pill or tablet, although in other non-limiting examples, blister 1110 may contain non-pharmaceutical products. In one non-limiting example, blister strip 1010 is a "solid form blister" arranged in a two-dimensional matrix, however, any type of configuration for blisters 1110 may be utilized with the invention. Also, blister strip 1010 includes a locking panel 1115 made preferably of semi-rigid plastic riveted to base 1105 at bottom surface 1107 at rear edge 1120 (i.e., rear edge 1120 is positioned at rear end 1020 in a locked position as shown in FIG. 10). Locking panel 1115 includes a generally trapezoidal portion 1125 which wraps around edge 1120 towards blisters 1110 in direction 1130 and includes an exposed edge 1135 provided to abut lip 1204 (FIG. 12) and enable the locking function of sleeve 1005 (FIG. 10), as will be shown and described below. In other non-limiting embodiments, pins, glue, staples or other similar types of attachment means may be utilized to couple locking panel 1115 to base 1105.

Turning to FIG. 11B, the rear perspective view of blister strip 1010 illustrates a backing 1140 affixed to the bottom surface of base 1105 and which act as seals 1145 for sealing the openings of each corresponding blister 1110. Backing 1140 is preferably constructed from aluminum foil, however, other types of foil or other materials such as paper and plastic may be used. In one non-limiting embodiment, backing 1140 may comprise perforations or cut-scores (not shown) surrounding the portion of the backing 1140 that coincides with the perimeter of the individual blister opening (i.e., seal 1145) to assist the user in penetrating the portion of backing 1140 that acts as seals 1145 or pushing the contents of the blister 1110 (FIG. 11A) through seal 1145. Also, locking panel 1115 includes a generally semi-spherical portion 1150 extending away from backing 1140 along an acute angle in direction 1132. Portion 1150 has a generally curved exposed edge 1155, which is provided to abut lip 1206 (FIG. 12) and prevent blister strip 1010 from being disengaged from sleeve 1005 (FIG. 10) in a fully extended (or open) position, which will be shown and described below.

Figure 12:
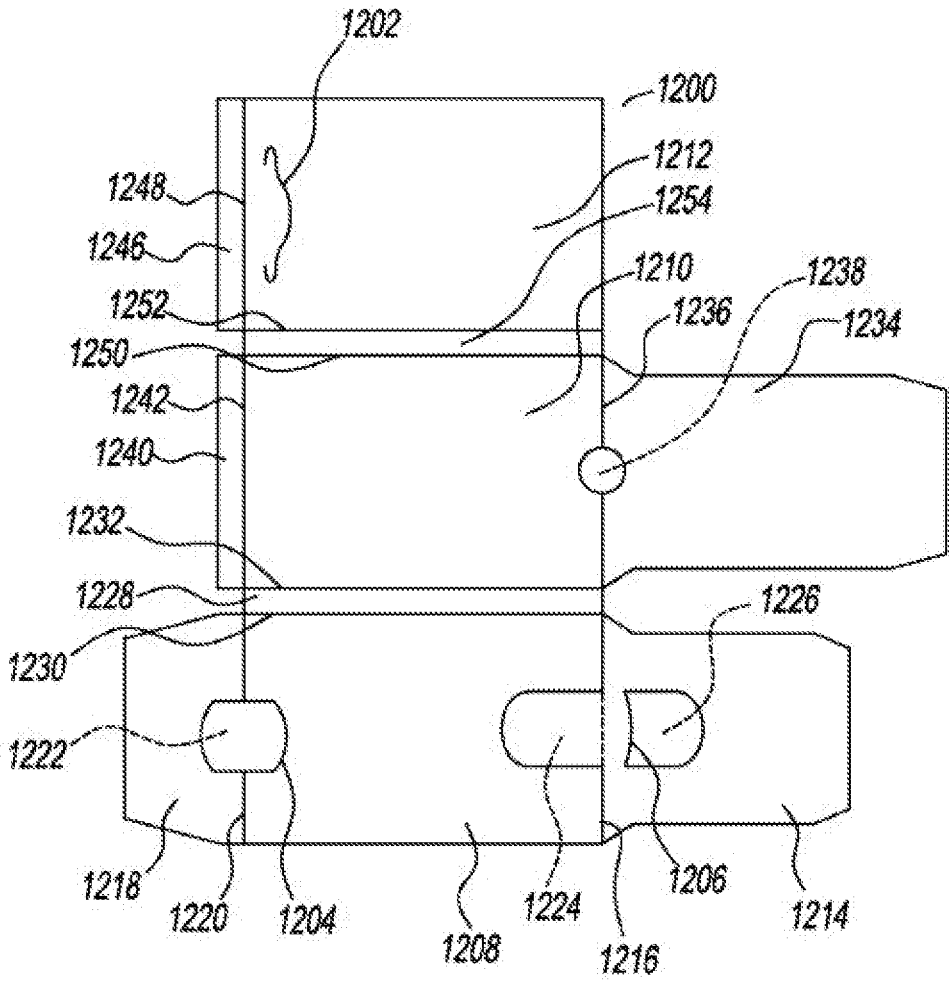
FIG. 12 is a top plane view of a pill dispenser housing (or sleeve) in accordance with the alternate embodiment of the invention.

FIG. 12 discloses a blank 1200 having various panels, folded along predetermined fold lines or pre-break lines in order to assemble sleeve 1005 according to an alternate embodiment of the invention. Blank 1200 is the sleeve 1005 in an unfolded position. Blank 1200 is preferably made of paperboard and may be coated with a polymer coating to make it more tear resistant, although in other non-limiting examples, blank 1200 may be made from durable paper, composite material, or other similar types of materials. The blank 1200 is preferably made up of several panels, which are folded along predetermined fold lines or pre-break lines in order to form sleeve 1005 (FIG. 10). The fold lines are scored while the pre-break lines are formed by a creasing operation, both of which are provided to make it easier to fold the various panels during assembly of sleeve 1005 (FIG. 10). Also, during the manufacturing process of sleeve 1005, the several panels are folded at desired folding angles (e.g., 90.degree. or 180.degree.) and panels 1214, 1218, 1208, 1240, 1246 and 1212 may be glued to fixably connect the panels together.

As shown, blank 1200 comprises inside panel 1208, top panel 1210 and bottom panel 1212. Inside panel 1208 is folded in relation to inside right panel 1214 about pre-break line 1216 (also first pre-break line) and is also folded in relation to inside left panel 1218 about pre-break line 1220 (also second pre-break line). Inside panel 1208 and inside left panel 1218 includes a generally rectangular cutout 1222 along pre-break line 1220. Also, inside panel 1208 includes a generally rectangular cut-out 1224 along pre-break line 1216 while inside right panel 1214 includes a generally rectangular cut-out 1226 partially disposed along pre-break line 1216. The cutout 1226 includes lip 1206 to prevent blister strip 1010 from being disengaged from sleeve 1005 (FIG. 10) when blister strip 1010 is fully extended in an open position, and which will be shown and described below.

Top panel 1210 is folded along pre-break line 1242 to form a top back panel 1240 while bottom panel 1212 is folded along pre-break line 1248 to form a bottom back panel 1246. Also, top panel 1210 is folded in relation to bottom panel 1212 about pre-break lines 1250 and 1252 to form a right folding panel 1254 between inside panel 1208 and top panel 1210. Inside panel 1208 includes a rectangular shaped cutout 1222 to form a protruding lip 1204, which abuts edge 1155 (FIG. 11B) and locks the blister strip 1110 within sleeve 1005. Also, top right panel 1234 is folded in relation to top panel 1210 about pre-break line 1236. Top right panel includes a spherically shaped cutout 1238 on the edge separating top right panel 1234 and top panel 1210. Cutouts 1224 and 1238 form grip-openings of sleeve 1005 making it possible to slide blister strip 1010 (FIG. 10) substantially out of the sleeve 1005 with a simple finger-grip.

Top panel 1210 is folded in relation to bottom panel 1210 about pre-break lines 1230 and 1232 to form a left folding panel 1228 between inside panel 1208 and top panel 1210. The blank 1200 includes a locking function comprising a partial cut-out 1202, which must be depressed in order to disengage the blister strip 1010 and enable a user to slide blister strip 1010 along direction 1002 (shown in FIG. 10) in order to access the contents of the blister strip 1010. It should be appreciated that blister strip 1010 engages a lip 1204 and sliding the blister strip 1010 prior to pushing portion 1202 prevents the lip 1204 (shown in FIG. 12) from disengaging the blister strip 1010, thereby preventing the blister strip 1010 from sliding out of the sleeve 1005, which will be shown and described below.

Figure 13:
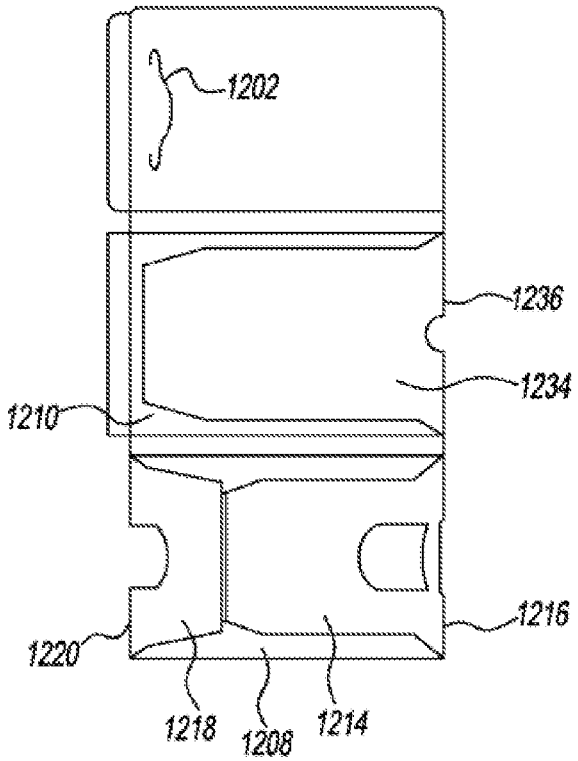
FIG. 13 is a top plane view of the housing of FIG. 12 with the inside left panel, inside right panel and top right panel folded.

Referring now to FIG. 12-15, the process of assembling sleeve 1005 (FIG. 10) may comprise folding the various panels of blank 1200 (FIG. 12) in a predetermined order. First, and as shown in FIGS. 12 and 13, inside right panel 1214 is folded 180 degrees along pre-break line 1216 and glued to inside panel 1208 to permanently position inside right panel 1218 within the perimeter of inside panel 1208. Next, inside left panel 1218 is folded 180 degrees along pre-break line 1220 and glued to inside panel 1208 to permanently position inside left panel 1218 within the perimeter of inside panel 1208. Next, top right panel 1234 is folded 180 degrees along pre-break line 1236 and glued to top panel 1210 to permanently position top right panel 1234 within the perimeter of top panel 1210.

Figure 14:
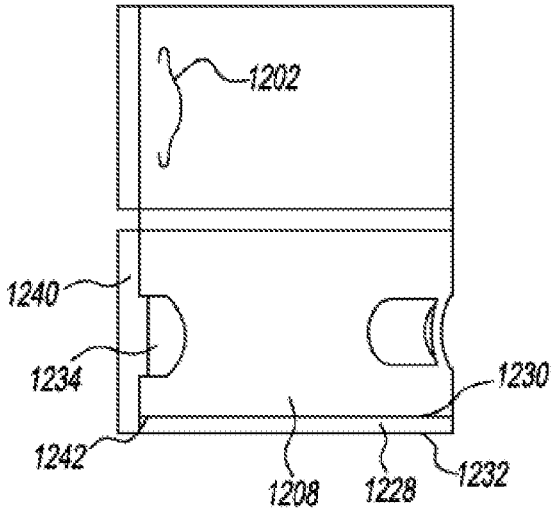
FIG. 14 is a top plane view of the housing of FIG. 12 with the inside panel further folded over the top panel and top right panel.
Figure 15:
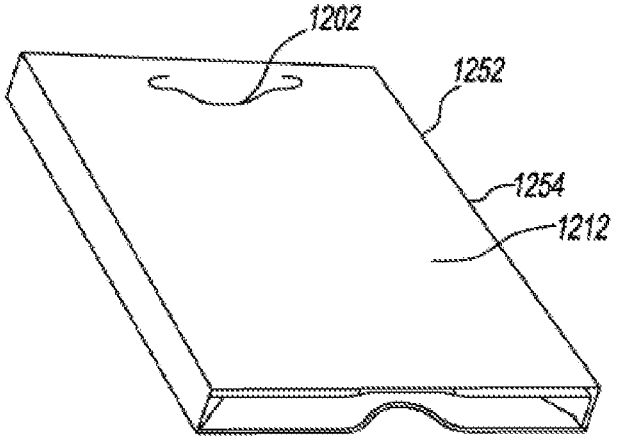
FIG. 15 is a perspective view of the assembled housing (or sleeve) shown in FIG. 10.

Next, as shown in FIG. 14, inside panel 1208 is folded 90 degrees along pre-break line 1230 and left folding panel 1228 is folded 90 degrees causing the footprint of inside panel 1208 to reside within the perimeter of top panel 1210. Also, top back panel 1240 (FIG. 12) is folded 90 degrees along pre-break line 1242 to form a back wall. Next, and as shown in FIG. 15, bottom panel 1212 is folded 90 degrees along pre-break line 1252 and right folding panel 1254 is folded 90 degrees along pre-break line 1250 (FIG. 12) causing bottom panel 1212 to reside on top of inside panel 1208 (FIG. 14). Bottom panel 1212 is glued to the exposed surface of inside panel 1208 to permanently couple bottom panel 1212 to inside panel. Finally, bottom back panel 1246 is folded 90 degrees and is glued to top back panel 1240 to form a permanent wall for sleeve 1005.

Figure 16:
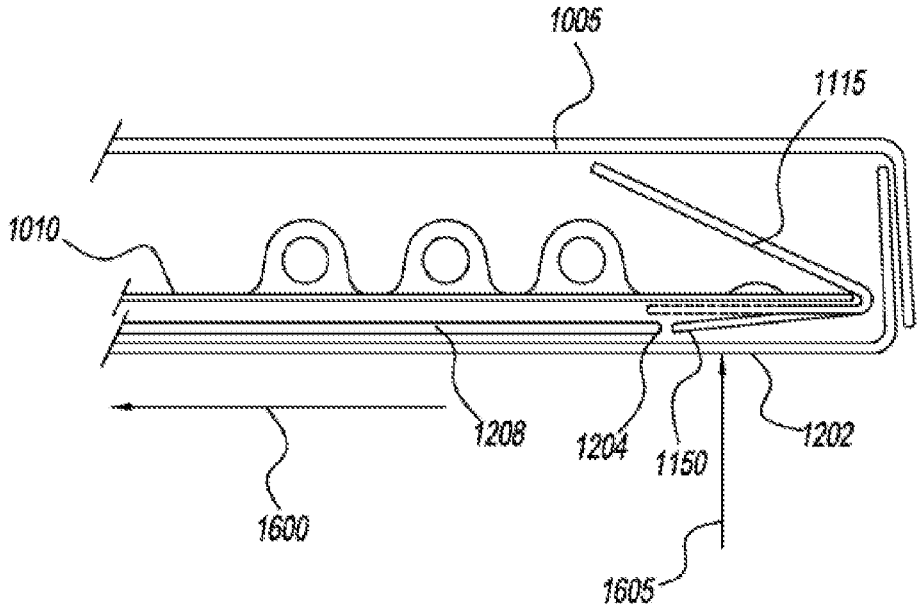
FIG. 16 is a partial cross-sectional view of the pill dispenser shown in FIG. 10, showing the panel being disengaged from the locked position.

In operation and as shown in FIGS. 10, 11A, 12 and 16, blister strip 1010 (FIG. 16) may be selectively locked within sleeve 1005 to form a "F1" child-resistant pill dispenser 1000. As shown in FIG. 16, the locking function is engaged by utilizing locking panel 1115 to engage protruding lip 1204 of inside panel 1208 and lock blister strip 1010 inside the cavity of sleeve 1005 until locking panel 1115 is disengaged. Particularly, when the pill dispenser 1000 is in its locked position, exposed edge 1155 (FIG. 11B) of portion 1150 (FIG. 16), which is aligned along vertical axis 1605, resides below lip 1204 (FIG. 16) and provides an obstruction preventing blister strip 1010 from sliding out in direction 1600. In order to release blister strip 1010, a depressible force is applied to portion 1202, also aligned along vertical axis 1605, prior to sliding blister strip 1010 in order to cause portion 1150 to be pushed upwards and clear lip 1204, thereby disengaging locking panel 1115 from inside panel 1208. The blister strip 1010 may now be selectively accessed by sliding blister strip 1010 along direction 1600. Further, as blister strip 1010 slides along direction 1600, it is prevented from being disengaged from sleeve 1005 by lip 1206 on inside right panel 1214 (FIG. 12), which abuts portion 1150. It should also be appreciated that sliding the blister strip 1010 prior to pushing portion 1202 prevents the lip 1204 from disengaging the locking panel 1115 even after a sliding force is applied to blister strip 1010 in direction 1600, thereby preventing the blister strip 1010 from sliding out of the sleeve 1005.

While the invention has been described with reference to one or more preferred embodiments, which embodiments have been set forth in considerable detail for the purposes of making a complete disclosure of the invention, such embodiments are merely exemplary and are not intended to be limiting or represent an exhaustive enumeration of all aspects of the invention. The scope of the invention, therefore, shall be defined solely by the following claims. Further, it will be apparent to those of skill in the art that numerous changes may be made in such details without departing from the spirit and the principles of the invention.

What is claimed is:

1. A packaging apparatus comprising:

a sleeve comprising:

an inside panel comprising a cut-out;

a bottom panel;

a top panel coupled to the bottom panel;

an inside folding panel coupled to the top panel and the inside panel;

an inside closing panel coupled to the inside panel;

a left panel coupled to the inside closing panel;

a left folding panel coupled to the bottom panel and the top panel;

an opening formed by the inside panel, the bottom panel, the top panel, the inside folding panel, and the inside closing panel;

a top right panel coupled to the inside panel, wherein the top right panel comprises a first hook;

a bottom right panel coupled to the top right panel, wherein the bottom right panel comprises a second hook;

a base slidable within the sleeve, the base comprising at least one blister and a locking member; and wherein the cutout forms a lip on said inside panel to receive the locking member.

2. The apparatus of claim 1, wherein the locking member comprises a male rivet member that abuts a top surface of the base.

3. The apparatus of claim 1, wherein the locking member comprises a female rivet member that abuts a bottom surface of the base.

4. The packaging apparatus of claim 1, wherein the sleeve comprises one or more hooks proximate to the opening.

5. The packaging apparatus of claim 4, wherein the sleeve and the locking member are configured so that the locking member abuts against the one or more hooks when the base is in a first position.

6. The packaging apparatus of claim 4, wherein the sleeve and the locking member are configured so that the locking member is received by the lip when the base is in a second position.

7. The packaging apparatus of claim 1, further comprising a button portion in the bottom panel, the button portion adapted to release the locking member upon application of a force thereto.

8. The apparatus of claim 1, wherein the locking member comprises a male rivet member that abuts a top surface of the base.

9. The apparatus of claim 1, wherein the locking member comprises a female rivet member that abuts a bottom surface of the base.

10. The packaging apparatus of claim 1, wherein the sleeve and the locking member are configured so that the locking member abuts against the one or more hooks when the base is in a first position.

11. The packaging apparatus of claim 10, wherein the sleeve and the locking member are configured so that the locking member is received by the lip when the base is in a second position.

12. The packaging apparatus of claim 1, wherein the sleeve and the locking member are configured so that the locking member is received by the lip when the base is in a second position.

13. The packaging apparatus of claim 1, further comprising a button portion in the bottom panel, the button portion adapted to release the locking member upon application of a force thereto.

* * * * *